US012135128B2

(12) United States Patent
Ten Hoeve et al.

(10) Patent No.: US 12,135,128 B2
(45) Date of Patent: Nov. 5, 2024

(54) METHOD TO OPERATE A MODULATING BURNER

(71) Applicant: BEKAERT COMBUSTION TECHNOLOGY B.V., Assen (NL)

(72) Inventors: Dirk Ten Hoeve, Assen (NL); Geert Folkers, Assen (NL)

(73) Assignee: BEKAERT COMBUSTION TECHNOLOGY B.V., Assen (NL)

( * ) Notice: Subject to any disclaimer, the term of this patent is extended or adjusted under 35 U.S.C. 154(b) by 540 days.

(21) Appl. No.: 17/436,423

(22) PCT Filed: Mar. 11, 2020

(86) PCT No.: PCT/EP2020/056543
§ 371 (c)(1),
(2) Date: Sep. 3, 2021

(87) PCT Pub. No.: WO2020/182902
PCT Pub. Date: Sep. 17, 2020

(65) Prior Publication Data

US 2022/0163203 A1 May 26, 2022

(30) Foreign Application Priority Data

Mar. 12, 2019 (EP) ..... 19162278

(51) Int. Cl.
*F23N 1/02* (2006.01)
*F23D 14/14* (2006.01)
*F23N 5/00* (2006.01)

(52) U.S. Cl.
CPC ..... *F23N 1/022* (2013.01); *F23D 14/145* (2013.01); *F23N 5/006* (2013.01);
(Continued)

(58) Field of Classification Search
CPC ..... F23N 1/022; F23N 5/006; F23N 2235/24; F23N 2237/10; F23N 2235/12; F23N 2233/08; F23D 14/145; F23C 2900/9901
See application file for complete search history.

(56) References Cited

U.S. PATENT DOCUMENTS 4,622,004 A * 11/1986 Dalhuisen ..... F23N 5/003 236/15 E
6,129,542 A * 10/2000 Gauba ..... F23N 1/022 431/278

(Continued)

FOREIGN PATENT DOCUMENTS

CN 201377796 1/2010
CN 101818901 9/2010

(Continued)

OTHER PUBLICATIONS

Communication pursuant to Article 94(3) issued Jul. 4, 2023, in European Patent Application No. 20 710 510.7.

(Continued)

*Primary Examiner* — Alfred Basichas
(74) *Attorney, Agent, or Firm* — Wenderoth, Lind & Ponack, L.L.P.

(57) ABSTRACT

The invention pertains to a method for operating a surface stabilized fully premixed gas premix burner. The burner is adapted to modulate between a minimum load and a full load, the ratio of the full load over the minimum load being at least 4. The method comprises the step of supplying a premix of combustible gas and air to the burner at an air to combustible gas ratio, the combustible gas supplied to the burner comprises at least 20% by volume of hydrogen, In the method, the air to combustible gas ratio of the premix which is supplied to the burner when the burner is operated at minimum load is set by a mechanism to be in relative terms (Continued)

at least 20% higher than the air to combustible gas ratio of the premix which is supplied to the burner when the burner is operated at full load.

26 Claims, 5 Drawing Sheets

(52) U.S. Cl.
CPC .. *F23C 2900/9901* (2013.01); *F23N 2233/08* (2020.01); *F23N 2235/12* (2020.01); *F23N 2235/24* (2020.01); *F23N 2237/10* (2020.01)

(56) References Cited

U.S. PATENT DOCUMENTS

| | | | |
|---|---|---|---|
| 2006/0286498 | A1 | 12/2006 | Trimis et al. |
| 2008/0318172 | A1 | 12/2008 | Geiger et al. |
| 2013/0115563 | A1 | 5/2013 | Blaauwwiekel et al. |
| 2015/0247639 | A1 | 9/2015 | Lovascio et al. |

FOREIGN PATENT DOCUMENTS

| | | |
|---|---|---|
| CN | 103443544 | 12/2013 |
| CN | 105987397 | 10/2016 |
| CN | 107166386 | 9/2017 |
| CN | 206973582 | 2/2018 |
| DE | 39 37 290 | 5/1990 |
| EP | 2 589 868 | 5/2013 |
| GB | 2 226 163 | 6/1990 |
| JP | 10-332112 | 12/1998 |
| JP | 2003-28415 | 1/2003 |
| WO | 95/23315 | 8/1995 |
| WO | 2014/060991 | 4/2014 |

OTHER PUBLICATIONS

"Victrix Tera 24-28, Istruzioni e avvertenze", (Jul. 2017), Immergas S.p.A. (cited in CA, which provides concise description of relevance on p. 5 thereof).

"Installation and Servicing Logic Combi ESPI", (Feb. 2018), Ideal Boilers Ltd. (cited in CA, which provide3s concise description of relevance on p. 5 thereof).

International Search Report and Written Opinion of the International Searching Authority issued Jun. 24, 2020, in International (PCT) Application No. PCT/EP2020/056543.

Extended European Search Report issued Aug. 6, 2019, in corresponding European Patent Application No. 19162278.6.

English language translation of Notice of Reasons for Refusal issued Jan. 12, 2024, in Japanese Patent Application No. 2021-554611.

H.R.N. Jones, "The Application of Combustion Principles to Domestic Gas Burner Design," ISBN 0-419-14800-0, Routledge (1998) pp. 1-193.

Third Party Observations concerning European Application No. EP20200710510 filed on Nov. 21, 2023.

* cited by examiner

METHOD TO OPERATE A MODULATING BURNER

The invention relates to the technical field of methods to operate modulating surface stabilized gas premix burners and more particularly burners wherein the combustible gas comprises at least 20% by volume of hydrogen.

It is more and more popular to modulate gas burners, this means to vary the burner load over a rather broad range, e.g. wherein the ratio of maximum to minimum burner load is higher than 4 or even higher.

Gas burners using natural gas are well established. The use of such burners is criticized because of the carbon dioxide emissions. The use of gas burners using 100% hydrogen or mixtures of natural gas with hydrogen seems an interesting solution to reduce carbon dioxide emissions. However, hydrogen—or gaseous fuels having a significant content of hydrogen—have a different combustion behavior than natural gas or than other hydrocarbon gases such as propane. The different combustion behavior leads to a number of problems, e.g. the burner is prone to flame flash back.

A mixture of combustible gas and air is supplied to surface stabilized premix gas burners. The ratio of the air to the combustible gas determines the performance of the burner. For complete combustion (e.g. to reduce emissions of carbon monoxide), sufficient air needs to be supplied. For high efficiency of heat transfer in the heat cell in which the surface stabilized gas burner is used, the amount of air should not be too high. Therefore, it is known to operate natural gas burners at a predefined constant air to combustible gas ratio, via a pneumatic gas valve or via a control mechanism using e.g. the measurement of the ionization current of the burner flame.

DE3937290A1 for instance discloses control of the air and/or fuel supplies to a burner-heated appliance in order to maintain an optimum ratio. A flame ionisation probe measures the flame conductivity, and any difference between the measured conductivity and a reference is used to adjust for example a gas valve and/or the speed of a fan.

US2008/318172A proposes a method for regulating a firing device taking into account the temperature and/or the burner load, in particular with a gas burner. The method comprises the regulation of the temperature produced by the firing device using a characteristic which shows a value range corresponding to a desired temperature dependent upon a first parameter corresponding to the burner load, wherein when representing the characteristic, a second parameter, preferably the air ratio (lambda), defined as the ratio of the actually supplied quantity of air to the quantity of air theoretically required for optimal stoichiometric combustion, is constant.

WO2014/060991A1 discloses an apparatus for adjusting and controlling the combustion in a fuel gas burner which is able to maintain optimal values of the air/gas ratio in order to obtain optimal emissions of carbon dioxide, carbon oxide and nitrogen oxides, regardless of the kind of gas used and of the power supplier by the burner. The apparatus comprises the following mutually integrated components: a comburant gas/fuel gas mixing pipe provided with a venturi mixer in correspondence of which a fuel gas supply duct opens; means for adjusting the flow rate of fuel gas; a fan, at least partially housed in the mixing pipe; a burner arranged downstream of the fan; a safety system based upon the detection of the flame present in the burner; and an electronic control unit of devices belonging to the apparatus. The apparatus further comprises a temperature probe arranged on the inner surface of the burner; a valve for adjusting the fuel gas flow rate in the duct; the valve belonging to the control means and being mechanically controlled by an actuator; and an electronic card, electronically connected to the probe, to the fan and to the actuator.

In accordance with the invention, a method is provided for operating a surface stabilized fully premixed gas premix burner, wherein the burner is adapted to modulate between a minimum load and a full load, and wherein the ratio of the full load over the minimum load is at least 4, which method comprises the step of:

supplying a premix of combustible gas and air to the burner at an air to combustible gas ratio, wherein the combustible gas supplied to the burner comprises at least 20% by volume of hydrogen, characterized in that:

the air to combustible gas ratio of the premix which is supplied to the burner when the burner is operated at minimum load is set by a mechanism to be in relative terms at least 20% higher than the air to combustible gas ratio of the premix which is supplied to the burner when the burner is operated at full load.

The burner is for example part of a burner system, which comprises further components to operate and control the burner. Optionally, the mechanism is part of the same burner system as the burner.

The burner is provided (in particular adapted) to modulate between a minimum load and a full load. The ratio of the full load over the minimum load is at least 4, e.g. more than 4; and preferably more than 5, more preferably more than 7, even more preferably more than 10.

In accordance with the invention, the air to combustible gas ratio of the premix supplied to the burner is set to be at minimum load of the burner in relative terms at least 20% higher than the air to combustible gas ratio supplied to the burner at full load of the burner. A mechanism is present to apply the correct setting of the air to combustible gas ratio.

As an example, when the air to combustible gas ratio at full load of the burner is 1.3; it means that the air to combustible gas ratio at minimum load is at least 1.20*1.3, meaning at least 1.56.

With "air to combustible gas ratio" is meant the ratio of the amount of air in the premix of air and combustible gas, relative to the theoretically stoichiometrically required amount of air for full combustion of the combustible gas.

With "burner load" (expressed in kW) is meant the quantity of energy supplied to the burner in a unit of time; the quantity of energy equals the mass flow rate multiplied with the calorific value of the combustible gas per unit of mass.

It is a benefit of the invention that under normal operating conditions flame flashback is prevented while the effect on overall efficiency of the heat exchanger in which the surface stabilized gas premix burner is used is very low. It has been observed that surface stabilized fully premixed gas burners supplied with hydrogen in the combustible gas are prone to flame flashback at low burner loads. This is believed to be caused by the high burning velocity of hydrogen, which is much higher than the burning velocity of natural gas. The method of the invention strongly reduces the probability or even solves the flame flashback by increasing the ratio of air to combustible gas at lower load levels. This way, at lower load levels, the exit speed of the premix gas flowing out of the burner deck is increased, the flame speed is reduced and the burner deck is cooled. These effects synergistically act to reduce flame flashback probability. As the air to gas ratio is only increased at lower load levels, the efficiency at higher load levels of the connected heat exchanger—which transfers heat from the flue gas generated by the burner to another medium, e.g. water—remains at the high level. Only at lower load the efficiency is somewhat lower because of the higher amount of excess air in the premix supply. However, when the efficiency is averaged over the total volume or mass of combustible gas converted by the burner over a certain period of time, the effect of the lower efficiency at lower burner load is very low.

Preferably, the combustible gas supplied to the surface stabilized fully premixed gas premix burner comprises at least 40% by volume of hydrogen; more preferably at least 60% by volume of hydrogen; more preferably at least 80% by volume of hydrogen. Optionally, the combustible gas supplied to the surface stabilized fully premixed gas premix burner comprises at least 95% by volume of hydrogen, or at least 98% by volume of hydrogen, or between 95% and 98% by volume of hydrogen. More preferably, the combustible gas is 100% hydrogen, with the exception of impurities and/or optionally odorant and/ or colorant.

Optionally, the burner which is used in the method according to the invention comprises a burner deck onto which combustion is stabilized when the burner is in operation. For example, the burner deck is or comprises a perforated metal plate, e.g. the burner deck is or comprises a cylindrical perforated metal plate. The premix of air and combustible gas flows from the inside of the cylindrical perforated metal plate through the perforations of the cylindrical perforated metal plate to its outside where it is combusted. Optionally, the cylindrical perforated metal plate is closed at one end by a metal end cap.

Optionally, the burner comprises a perforated plate (i.e. a plate with holes), e.g. a perforated metal plate, which is fully or partially covered with fibrous metal material, for example a woven or knitted fibrous metal material. For example, the fibrous material which is in the art known as "NIT" can be used. For example, the fibrous metal material covers fully or partially the area of the perforated plate which comprises the holes.

Optionally, the burner comprises a perforated plate, e.g. a perforated metal plate, which perforated plate comprises holes in only a part of the surface of that perforated plate, e.g. only in a region of the plate which forms an axial end of the burner or an axial end of a burner deck of the burner. Optionally, a fibrous metal material, e.g. a woven or knitted fibrous metal material, e.g. the fibrous material which is in the art known as "NIT" , covers the part of the surface of the perforated plate which comprises the holes.

Optionally, the burner comprises a burner deck which comprises a gauze. Optionally the gauze is covered with fibrous metal material, for example a woven or knitted fibrous metal material. For example, the fibrous material which is in the art known as "NIT" can be used.

Optionally, the burner deck of the burner is or comprises a woven or knitted deck, in particular a deck of a woven or knitted fibrous metal material.

Optionally, the burner deck is or comprises a ceramic plate with holes.

Optionally, in the method according to the invention, the air to combustible gas ratio of the premix supplied to the burner is set to be at minimum load of the burner in relative terms at least 25% higher—and more preferably in relative terms at least 35% higher—than the air to combustible gas ratio supplied to the burner at full load of the burner. For example, the air to combustible gas ratio of the premix supplied to the burner is set to be at minimum load of the burner in relative terms at least 40% higher—optionally even in relative terms at least 60% higher—than the air to combustible gas ratio supplied to the burner at full load of the burner.

Optionally, the method according to the invention is carried out using a burner or burner system which comprises a fan for supply of the air to the burner or for supply of the premix of combustible air and gas to the burner. The fan for example forms part of a burner load controller.

Optionally, the method according to the invention is carried out using a burner system or burner according to the invention.

In an embodiment of the method according to the invention, the air to combustible gas ratio at average load is in relative terms less than 10% higher than the air to combustible gas ratio at full load. The average load is defined as the average between minimum load and full load. Optionally, the air to combustible gas ratio is at average load in relative terms less than 5% higher than the air to combustible gas ratio at full load.

In an embodiment of the method according to the invention, the air to combustible gas ratio at average load is in relative terms more than 5%—and preferably in relative terms more than 10%—less than the average between the air to combustible gas ratios at minimum load and at full load. The average load is defined as the average between minimum load and full load.

In an embodiment of the method according to the invention, the air to combustible gas ratio of the premix gas supplied to the burner at full load is less than 1.3, preferably less than 1.25.

In an embodiment of the method according to the invention, the air to combustible gas ratio of the premix gas which is supplied to the burner is set by the mechanism as a predefined function of the burner load.

This can for example be achieved when the mechanism uses a pneumatic gas valve to set the rate of supply of combustible gas to the burner, in order to set the air to combustible gas ratio of the premix supplied to the burner as a predefined function of the burner load.

Optionally, a pneumatic gas valve is used which comprises a spring, and one or more properties of the spring determine at least in part the predefined function.

In an embodiment of the method according to the invention, air or the premix of combustible air and gas is supplied to the burner or the burner system by a fan (e.g. a fan of a burner load controller), and the amount of air supplied to the burner is measured by a sensor. Alternatively or in addition, the fan speed is used as an indication for the amount of air supplied to the burner or burner system, or a pressure drop is recorded as measure for the amount of air supplied to the burner or the burner system. In this embodiment, the amount of combustible gas supplied to the burner is set according to a predefined relation to the amount of air supplied to the burner. For example, an electrically controlled valve can be used to set the amount of combustible gas supplied to the burner.

In an embodiment of the method according to the invention, air or the premix of combustible air and gas is supplied to the burner or to the burner system by a fan (e.g. a fan of a burner load controller), and the amount of combustible gas supplied to the burner is measured by a sensor. In this embodiment, the amount of air supplied to the burner is set according to a predefined relation to the amount of combustible gas supplied to the burner. For example, controlling the fan speed can be used to set the amount of air supplied to the burner.

In an embodiment of the method according to the invention, air or the premix of combustible air and gas is supplied to the burner by a fan (e.g. a fan of a burner load controller), and a value providing information of the combustion, of the flue gas and/or of the air to gas mixture supplied to the burner is measured by at least one sensor. In this embodiment, this value is used in combination with a value indicative of the burner load, of the fan speed and/or of the flow rate of air supplied to the burner to set the air to combustible gas ratio.

Optionally, in this embodiment, the at least one sensor is or comprises a temperature sensor and the value providing information of the combustion is representative for the flue gas temperature or for the flame temperature of the burner.

Optionally, in this embodiment, the burner which is used in the method according to the invention comprises a burner deck onto which combustion is stabilized when the burner is in operation, and the at least one sensor is or comprises a temperature sensor (e.g. a thermocouple) and the value providing information of the combustion is representative for the temperature of the burner deck of the burner.

Optionally, in this embodiment, alternatively or in addition, the at least one sensor is provided to measure a value representative for the oxygen content of the flue gas generated by the burner or representative for the oxygen content of the premix of air and combustible gas supplied to the premix burner.

In an embodiment of the method according to the invention, the burner which is used comprises a perforated metal plate onto which the flames are stabilized.

The method according to the invention can for example be carried out using a surface stabilized fully premixed gas premix burner system according to the invention.

The invention further pertains to a surface stabilized fully premixed gas premix burner system, which burner system comprises:

- a burner comprising a burner deck, which burner deck comprises a plurality of holes,
- an air inlet, a combustible gas inlet and a mixer which is in communication with the air inlet and the combustible gas inlet, which mixer is adapted to mix air and combustible gas to a premix of combustible gas and air at an air to combustible gas ratio, wherein the combustible gas inlet is suitable for receiving a combustible gas which contains at least 20% by volume of hydrogen,
- a burner inlet which is adapted to receive the premix of combustible gas and air and supply it to the burner,
- a burner load controller, which is adapted to vary the load of the burner between a minimum load and a full load, and wherein the ratio of the full load over the minimum load is at least 4, therewith allowing the burner to modulate between the minimum load and the full load, and
- a mechanism which is adapted to set the air to combustible gas ratio of the premix of combustible gas and air which is created by the mixer, which setting of the air to combustible gas ratio of the premix of combustible gas and air is at least partially dependent from the load of the burner, and wherein the air to combustible gas ratio of the premix which is supplied to the burner when the burner is operated at minimum load is set by the mechanism to be in relative terms at least 20% higher than the air to combustible gas ratio of the premix which is supplied to the burner when the burner is operated at full load.

In the burner of the burner system according to the invention, preferably the combined surface area of the holes is up to 5% of the surface area of the burner deck. This allows the burner system to use combustible gas which contains at least 20% by volume of hydrogen. A combustible gas containing at least 20% of hydrogen behaves rather different from the regular natural gas that is used in gas burners. In particular combustible gases which have a high percentage by volume of hydrogen (e.g. at least 40%, at least 50%, at least 80%, at least 95%, at least 98%, between 95% and 98%; and 100% with inevitable impurities) benefit from the combined surface area of the holes being up to 5% of the surface area of the burner deck.

The combined surface area of the holes is more than 0% of the surface area of the burner deck.

Optionally, the combined surface area of the holes is between 0.5% and 5% of the surface area of the burner deck, for example between 1% and 5% of the surface area of the burner deck.

Optionally, the combustible gas inlet is suitable for receiving a combustible gas which contains at least 20% by volume of hydrogen, and the combined surface area of the holes is up to 10% of the surface area of the burner deck.

Optionally, the combustible gas inlet is suitable for receiving a combustible gas which contains at least 50% by volume of hydrogen, and the combined surface area of the holes is up to 9.5% of the surface area of the burner deck.

Optionally, the combustible gas inlet is suitable for receiving a combustible gas which contains at least 95% by volume of hydrogen, and the combined surface area of the holes is up to 5% of the surface area of the burner deck.

Optionally, the combustible gas inlet is suitable for receiving a combustible gas which contains at least 98% by volume of hydrogen, and the combined surface area of the holes is up to 5% of the surface area of the burner deck.

Optionally, the combustible gas inlet is suitable for receiving a combustible gas which contains between 95% and 98% by volume of hydrogen, and the combined surface area of the holes is up to 5% of the surface area of the burner deck.

Optionally, the combustible gas inlet is suitable for receiving a combustible gas which contains 100% by volume of hydrogen, apart from inevitable impurities, and the combined surface area of the holes is up to 5% of the surface area of the burner deck.

In a surface stabilized gas burner, the position of the flame is at least substantially determined by the burner deck of the burner. The burner deck is the part of the burner in which the holes are present through which the premix of combustible gas and air leaves the burner to be combusted. The burner deck in particular does not include any blind areas without such holes, e.g. adjacent to one or both axial ends of a cylindrical burner. In case of any blind areas, the border between the burner deck and the blind area can be defined as being located at a distance of half the pitch of the holes in the burner deck, starting from the center of the outermost hole or holes of the burner deck. The pitch is the center-to-center distance of two adjacent holes in the burner deck.

The burner system according to the invention comprises a burner comprising a burner deck. The burner deck comprises a plurality of holes. During use of the burner system, the premix of combustible gas and air leaves the burner through these holes to be combusted. So, the flame is fed via the plurality of holes. In operation, the flame is stabilized on the burner deck.

Optionally, the burner deck is or comprises a perforated metal plate. For example, the burner deck is a cylindrical perforated metal plate; wherein the premix of air and combustible gas flows from the inside of the cylindrical perforated metal plate through the perforations of the cylindrical perforated metal plate to its outside where it is combusted. Optionally, the cylindrical perforated metal plate is closed at one end by a metal end cap.

Optionally, the burner comprises a gas distributor which is adapted to distribute the gas over the burner deck in a predetermined way.

The burner system according to the invention further comprises an air inlet, a combustible gas inlet and a mixer which is in communication with the air inlet and the combustible gas inlet. The mixer is adapted to mix air and combustible gas to a premix of combustible gas and air at an air to combustible gas ratio. Optionally, the mixer is or comprises a venturi.

The combustible gas inlet is suitable for receiving a combustible gas which contains at least 20% by volume of hydrogen. This is for example achieved by that the combustible gas inlet meets any regulatory requirements for retaining such a combustible gas, that the combustible gas inlet is made of a suitable material and/or that the combustible gas inlet is connectable, either directly or indirectly, to a source of combustible gas which contains at least 20% by volume of hydrogen.

With "air to combustible gas ratio" is meant the ratio of the amount of air in the premix of air and combustible gas, relative to the theoretically stoichiometrically required amount of air for full combustion of the combustible gas.

The burner system according to the invention further comprises a burner inlet which is adapted to receive the premix of combustible gas and air and supply it to the burner. The burner inlet is arranged upstream of the mixer and downstream of the burner, as seen in the direction of the flow of combustible gas and air through the burner system.

The burner system according to the invention further comprises a burner load controller, which is adapted to vary the load of the burner between a minimum load and a full load. The ratio of the full load over the minimum load is at least 4, e.g. more than 4, therewith allowing the burner to modulate between the minimum load and the full load.

With "burner load" (expressed in kW) is meant the quantity of energy supplied to the burner in a unit of time; the quantity of energy equals the mass flow rate multiplied with the calorific value of the combustible gas per unit of mass.

The burner is provided (in particular adapted) to modulate between a minimum load and a full load. The ratio of the full load over the minimum load is at least 4, e.g. more than 4; and preferably more than 5, more preferably more than 7, even more preferably more than 10.

The burner system according to the invention further comprises a mechanism which is adapted to set the air to combustible gas ratio of the premix of combustible gas and air which is created by the mixer. The setting of the air to combustible gas ratio of the premix of combustible gas and air is at least partially dependent from the load of the burner. The air to combustible gas ratio of the premix which is supplied to the burner when the burner is operated at minimum load is set by the mechanism to be in relative terms at least 20% higher than the air to combustible gas ratio of the premix which is supplied to the burner when the burner is operated at full load.

As an example, when the air to combustible gas ratio at full load of the burner is 1.3; it means that the air to combustible gas ratio at minimum load is at least 1.20*1.3, meaning at least 1.56.

Preferably, the mechanism which is adapted to set the air to combustible gas ratio of the premix supplied to the burner to be at minimum load of the burner in relative terms at least 25% higher—and more preferably in relative terms at least 35% higher—than the air to combustible gas ratio supplied to the burner at full load of the burner. More preferably, the mechanism is adapted to set the air to combustible gas ratio of the premix supplied to the burner is set to be at minimum load of the burner in relative terms at least 40% higher—and more preferably in relative terms at least 60% higher—than the air to combustible gas ratio supplied to the burner at full load of the burner.

In an embodiment of the burner system according to the invention, the burner system further comprises a controller. The controller is programmed to control the mechanism such that the air to combustible gas ratio of the premix which is supplied to the burner when the burner is operated at minimum load is set by the mechanism to be in relative terms at least 20% higher than the air to combustible gas ratio of the premix which is supplied to the burner when the burner is operated at full load.

The controller for example is or comprises a microprocessor, a plc system and/or a pneumatic system.

In an embodiment, the controller comprises a data input port, which is connectable to a sensor or sensor system to receive a signal containing measurement data which is generated by the sensor or sensor system. The controller is adapted to generate a control signal on the basis of the signal containing the measurement data which is received from the sensor or the sensor system. The control signal is delivered to the data output which is connectable to the mechanism to determine the setting of the mechanism in order to control the air to combustible gas ratio. The connection between the sensor or sensor system and the data input port of the controller may be direct or indirect, and wired or wireless. The connection between the data output port of the controller and the mechanism may be direct or indirect, and wired or wireless.

In an embodiment of the burner system according to the invention, the mechanism is adapted to set the air to combustible gas ratio of the premix gas which is supplied to the burner as a predefined function of the burner load.

In an embodiment of the burner system according to the invention, the mechanism comprises a pneumatic gas valve, which pneumatic gas valve is adapted to set the rate of supply of combustible gas to the burner, in order to set the air to combustible gas ratio of the premix supplied to the burner as a predefined function of the burner load.

Optionally, the pneumatic gas valve comprises a spring, and wherein properties of the spring determine at least in part the predefined function.

In an embodiment of the burner system according to the invention, the burner system further comprises a fan, which fan is arranged to supply air to the mixer or to supply the premix of combustible air and gas to the burner. The fan optionally forms part of the burner load controller and/or is controlled by the burner load controller or elements thereof.

In an embodiment of the burner system according to the invention, the burner system further comprises a fan, which fan is arranged to supply air to the mixer or to supply the premix of combustible air and gas to the burner, and the burner system further comprises:

- a sensor, which sensor is adapted to measure the amount of air supplied to the burner,
- a combustible gas supply controller which is adapted to control the amount of combustible gas supplied to the mixer and/or to the burner, which combustible gas supply controller is adapted to set the amount of combustible gas supplied to the burner according to a predefined relation to the amount of air supplied to the burner as measured by the sensor.

The fan optionally forms part of the burner load controller and/or is controlled by the burner load controller or elements thereof.

In an embodiment of the burner system according to the invention, the burner system further comprises a fan, which fan is arranged to supply air to the mixer or to supply the premix of combustible air and gas to the burner, and the fan has a variable fan speed. In this embodiment, the burner system further comprises:

a combustible gas supply controller which is adapted to control the amount of combustible gas supplied to the mixer and/or to the burner, which combustible gas supply controller is adapted to set the amount of combustible gas supplied to the burner according to a predefined relation to the amount of air supplied to the burner, for which amount of air the fan speed of the fan is a measure.

The fan optionally forms part of the burner load controller and/or is controlled by the burner load controller or elements thereof.

In an embodiment of the burner system according to the invention, the burner system further comprises a fan, which fan is arranged to supply air to the mixer or to supply the premix of combustible air and gas to the burner, and the burner system further comprises:

a sensor, which sensor is adapted to measure the amount of combustible gas supplied to the burner, an air supply controller which is adapted to control the amount of air supplied to the mixer and/or to the burner, which air supply controller is adapted to set the amount of air supplied to the burner according to a predefined relation to the amount of combustible gas supplied to the burner as measured by the sensor.

The fan optionally forms part of the burner load controller and/or is controlled by the burner load controller or elements thereof.

In a further embodiment of the burner system according to the invention, the burner system further comprises a controller. The controller is programmed to control the mechanism such that the air to combustible gas ratio of the premix which is supplied to the burner when the burner is operated at minimum load is set by the mechanism to be in relative terms at least 20% higher than the air to combustible gas ratio of the premix which is supplied to the burner when the burner is operated at full load. In this embodiment, the burner system further comprises:

a fan, which fan is arranged to supply air to the mixer or to supply the premix of combustible air and gas to the burner, a sensor, which sensor is adapted to measure a value providing information of the combustion, of the flue gas and/or of the air to gas mixture supplied to the burner, therewith generating measurement data pertaining to said value, wherein the controller is adapted to receive the measurement data pertaining to said value from the sensor and to use said measurement data in combination with a value indicative of the burner load, of the fan speed and/or of the flow rate of air supplied to the burner to control the mechanism to set the air to combustible gas ratio of the premix.

The fan optionally forms part of the burner load controller and/or is controlled by the burner load controller or elements thereof.

Optionally, the at least one sensor is or comprises a temperature sensor and wherein the value providing information of the combustion is representative for the flue gas temperature and/or for the flame temperature of the burner.

Optionally, the at least one sensor is or comprises a temperature sensor and the value providing information of the combustion is representative for the temperature of the burner deck of the burner.

Optionally, the at least one sensor is adapted to measure a value representative for the oxygen content of the flue gas generated by the burner or representative for the oxygen content of the premix of air and combustible gas supplied to the burner.

The invention further pertains to a method to operate a surface stabilized fully premixed gas premix burner;

wherein a premix of combustible gas and air is supplied to the burner;

wherein the combustible gas supplied to the burner comprises at least 20% by volume of hydrogen;

wherein the burner is provided to modulate between a minimum load and a full load;

wherein the ratio of the full load over the minimum load is more than 4;

characterized in that the burner comprises a mechanism such that the air to combustible gas ratio of the premix supplied to the burner is set to be at minimum load of the burner in relative terms at least 20% higher than the air to combustible gas ratio supplied to the burner at full load of the burner.

In this further method, a premix of combustible gas and air is supplied to the burner. The combustible gas supplied to the burner comprises at least 20% by volume of hydrogen. The burner is provided to modulate between a minimum load and a full load. The ratio of the full load over the minimum load is more than 4; and preferably more than 5, more preferably more than 7, even more preferably more than 10. Optionally, the ratio of the full load over the minimum load is at least 4. The burner comprises a mechanism such that the air to combustible gas ratio of the premix supplied to the burner is set to be at minimum load of the burner in relative terms at least 20% higher than the air to combustible gas ratio supplied to the burner at full load of the burner.

As an example, when the air to combustible gas ratio at full load of the burner is 1.3; it means that the air to combustible gas ratio at minimum load is at least 1.20*1.3, meaning at least 1.56.

With "air to combustible gas ratio" is meant the ratio of the amount of air in the premix of air and combustible gas, relative to the theoretically stoichiometrically required amount of air for full combustion of the combustible gas.

With "burner load" (expressed in kW) is meant the quantity of energy supplied to the burner in a unit of time; the quantity of energy equals the mass flow rate multiplied with the calorific value of the combustible gas per unit of mass.

It is a benefit of the invention that flame flashback is prevented while the effect on overall efficiency of the heat exchanger in which the surface stabilized gas premix burner is used is very low. It has been observed that surface stabilized fully premixed gas burners supplied with hydrogen in the combustible gas are prone to flame flashback at low burner loads. This is believed to be caused by the high burning velocity of hydrogen, which is much higher than the burning velocity of natural gas. The method of the invention strongly reduces the probability or even solves the flame flashback by increasing the ratio of air to combustible gas at lower load levels. This way, at lower load levels, the exit speed of the premix gas flowing out of the burner deck is increased, the flame speed is reduced and the burner deck is cooled. These effects synergistically act to reduce flame flashback probability. As the air to gas ratio is only increased at lower load levels, the efficiency at higher load levels of the connected heat exchanger—which transfers heat from the flue gas generated by the burner to another medium, e.g. water—remains at the high level. Only at lower load the efficiency is somewhat lower because of the higher amount of excess air in the premix supply. However, when the efficiency is averaged over the total volume or mass of combustible gas converted by the burner over a certain period of time, the effect of the lower efficiency at lower burner load is very low.

Preferably, the combustible gas supplied to the surface stabilized fully premixed gas premix burner comprises at least 40% by volume of hydrogen; more preferably at least 60% by volume of hydrogen; more preferably at least 80% by volume of hydrogen. More preferably, the combustible gas is 100% hydrogen, with the exception of impurities.

In a preferred method, the burner or burner system comprises a fan for supply of the air to the burner or for supply of the premix of combustible air and gas to the burner. The fan optionally forms part of a burner load controller and/or is controlled by a burner load controller or elements thereof.

Preferably, the burner comprises a burner deck onto which combustion is stabilized when the burner is in operation. More preferably, the burner deck is or comprises a perforated metal plate. Even more preferably, the burner deck is a cylindrical perforated metal plate; wherein the premix of air and combustible gas flows from the inside of the cylindrical perforated metal plate through the perforations of the cylindrical perforated metal plate to its outside where it is combusted. Even more preferably, the cylindrical perforated metal plate is closed at one end by a metal end cap.

Preferably, the burner or the burner system comprises a mechanism such that the air to combustible gas ratio of the premix supplied to the burner is set to be at minimum load of the burner in relative terms at least 25% higher—and more preferably in relative terms at least 35% higher—than the air to combustible gas ratio supplied to the burner at full load of the burner. More preferably, the burner comprises a mechanism such that the air to combustible gas ratio of the premix supplied to the burner is set to be at minimum load of the burner in relative terms at least 40% higher—and more preferably in relative terms at least 60% higher—than the air to combustible gas ratio supplied to the burner at full load of the burner.

In a preferred method, the air to combustible gas ratio at average load is in relative terms more than 5%—and preferably in relative terms more than 10%—less than the average between the air to combustible gas ratios at minimum load and at full load. The average load is defined as the average between minimum load and full load.

Preferably, the air to combustible gas ratio at average load is in relative terms less than 10% higher than the air to combustible gas ratio at full load. Even more preferred is when the air to combustible gas ratio is at average load in relative terms less than 5% higher than the air to combustible gas ratio at full load. The average load is defined as the average between minimum load and full load.

Preferably, the air to combustible gas ratio of the premix gas supplied to the burner at full load is less than 1.3; preferably less than 1.25.

Preferably, the mechanism involves setting the air to combustible gas ratio of the premix gas supplied to the burner as a predefined function of the burner load.

In a preferred method wherein the mechanism involves setting the air to combustible gas ratio of the premix gas supplied to the burner as a predefined function of the burner load, the mechanism uses a pneumatic gas valve to set the rate of supply of combustible gas to the burner in order to set the air to combustible gas ratio of the premix supplied to the burner as a predefined function of the burner load. More preferably, the properties of the spring in the pneumatic gas valve implement at least in part the predefined function.

In a preferred method wherein the mechanism involves setting the air to combustible gas ratio of the premix gas supplied to the burner as a predefined function of the burner load, the burner or the burner system comprises a fan for supply of the air or for supply of the premix of combustible air and gas to the burner. A sensor is used to measure the amount of air supplied to the burner, or the fan speed is used as measure for the amount of air supplied to the burner; or the pressure drop is recorded as measure for the amount of air supplied to the burner. The amount of combustible gas supplied to the burner is set—e.g. via an electronically controlled valve—according to a predefined relation to the amount of air supplied to the burner.

In a preferred method, the burner or the burner system comprises a fan for supply of the air to the burner or for supply of the premix of combustible air and gas to the burner. A sensor is used to measure the amount of combustible gas supplied to the burner; and the amount of air supplied to the burner is set—e.g. via controlling the fan speed—according to a predefined relation to the burner load, which is determined by the amount of combustible gas supplied to the burner.

In a preferred method, the burner or the burner system comprises a fan for supply of the air or of the premix of combustible air and gas to the burner. At least one sensor is used to measure a value providing information of the combustion, of the flue gas or of the air to gas mixture supplied to the burner. This value is used in combination with a value indicative of the burner load, of the fan speed or of the flow rate of air supplied to the burner to set the air to gas ratio.

In a preferred method, wherein at least one sensor is used, the at least one sensor comprises a temperature sensor and the value providing information of the combustion is representative for the flue gas temperature or for the flame temperature of the burner.

In a preferred method, wherein at least one sensor is used, the at least one sensor comprises a temperature sensor (e.g. a thermocouple) and the value providing information of the combustion is representative for the temperature of the burner deck of the burner. In such methods, the burner comprises a burner deck onto which combustion is stabilized when the burner is in operation.

In a preferred method, wherein at least one sensor is used, the at least one sensor is provided to measure a value representative for the oxygen content of the flue gas generated by the burner or representative for the oxygen content of the premix of air and combustible gas supplied to the premix burner.

Preferably, the burner comprises a perforated metal plate onto which the flames are stabilized.

The invention further pertains to a surface stabilized fully premixed gas premix burner comprising a mechanism for implementation of a method as in any embodiment of the first aspect of the invention.

Preferably, the surface stabilized fully premixed gas premix burner comprises a controller. The controller is programmed to operate the burner according to a method as in any embodiment of the first aspect of the invention.

Preferably, the burner comprises a burner deck onto which combustion is stabilized when the burner is in operation. More preferably, the burner deck is a perforated metal plate. Even more preferably, the burner deck is a cylindrical perforated metal plate; wherein the premix of air and combustible gas flows from the inside of the cylindrical perforated metal plate through the perforations of the cylindrical perforated metal plate to its outside where it is combusted. Even more preferably, the cylindrical perforated metal plate is closed at one end by a metal end cap.

FIG. 1 schematically explains a method of controlling a surface stabilized fully premixed gas premix burner using a constant air to combustible gas ratio over the full range of burner operation from minimum to full burner load.

FIGS. 2 and 3 schematically explain methods according to the invention.

Figure 6:
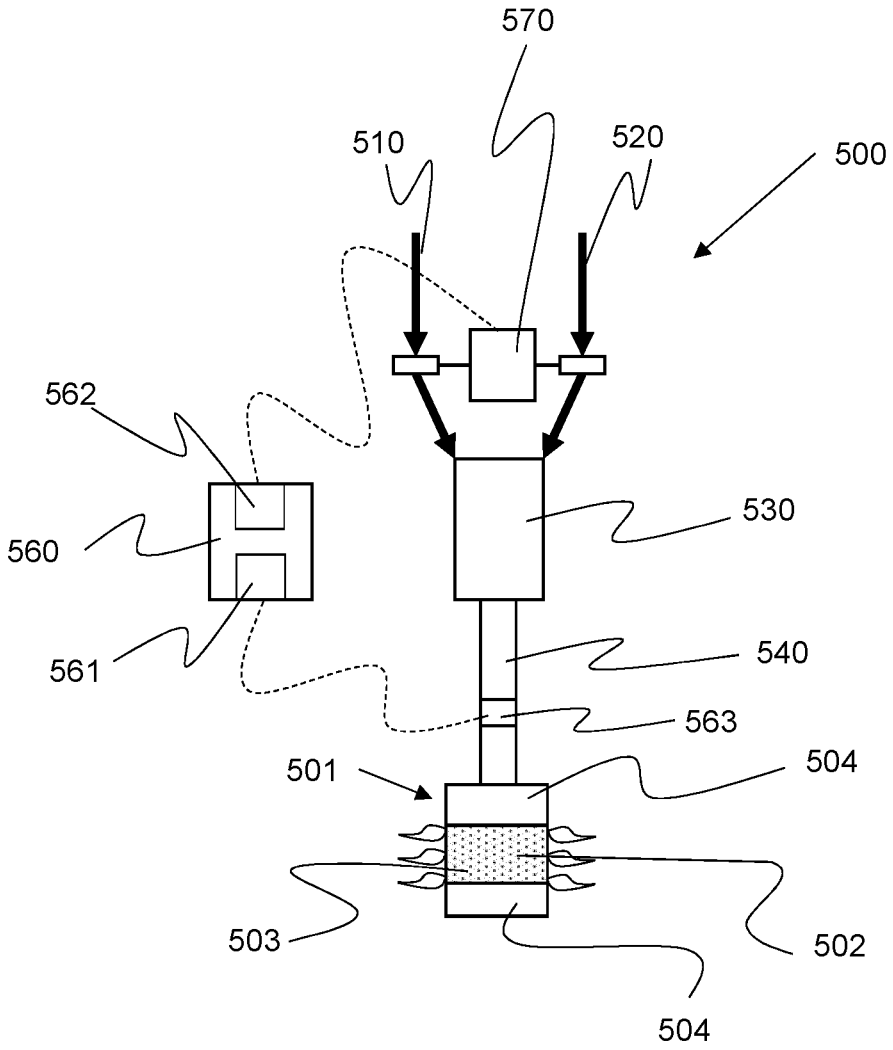

FIG. 6 schematically shows an embodiment of a burner system according to the invention.

Figure 7:
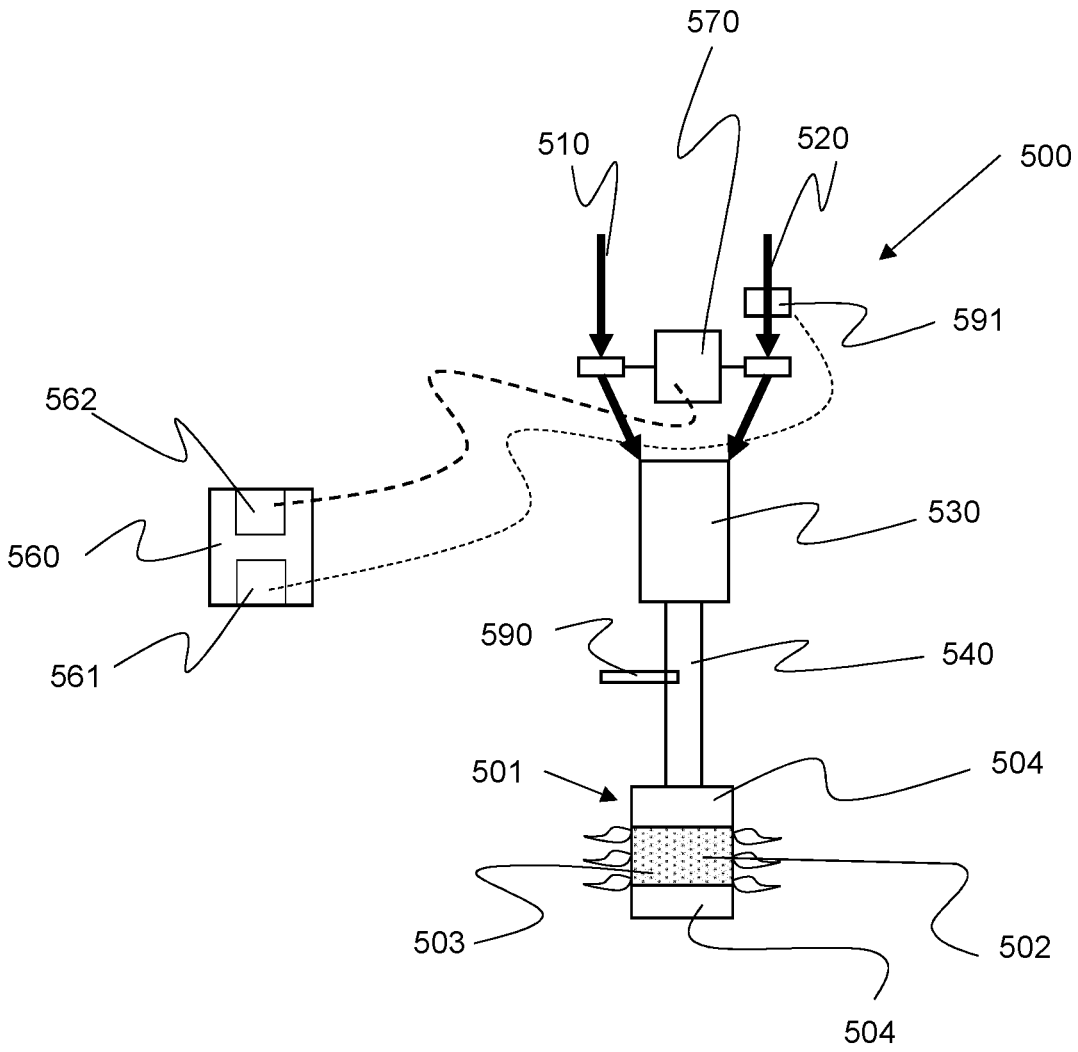

FIG. 7 schematically shows a variant of the embodiment of FIG. 6.

Figure 8:
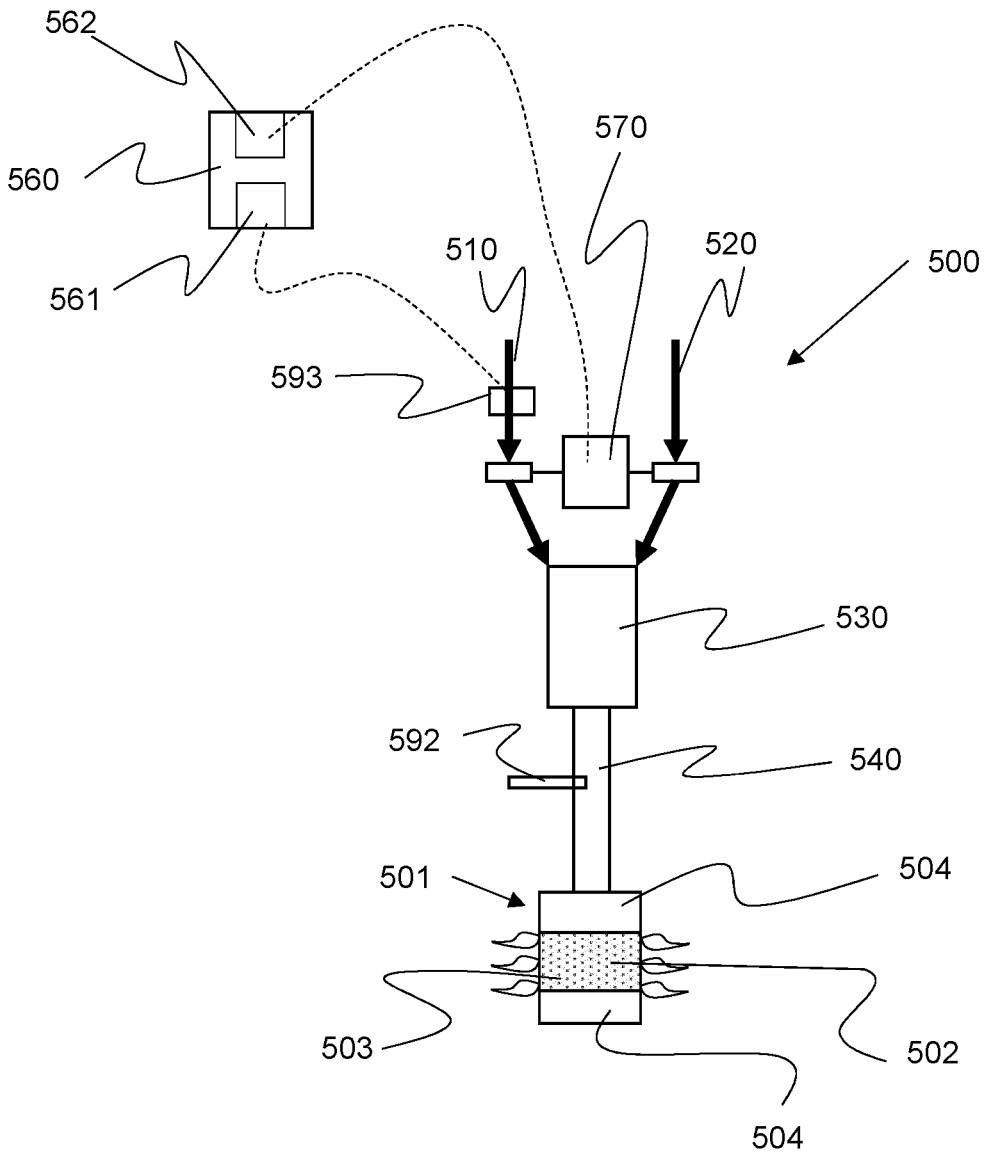

FIG. 8 schematically shows a further variant of the embodiment of FIG. 6.

The invention relates to a method to operate a surface stabilized fully premixed gas premix burner wherein the combustible gas supplied to the burner comprises at least 20% by volume of hydrogen and has as benefit that flame flash back is prevented. Although flame flashback is a complex phenomenon, it is related to the ratio of the exit velocity (m/s) of the premix gas through the burner deck to the burning velocity (also in m/s) of the combustible gas. The exit velocity is proportional to the volume flow of the premix gas divided by the surface of the through holes of the burner deck onto which combustion is stabilized. Although the burning velocity depends on a number of parameters, e.g. temperature of the gas premix and/or air to combustion ratio of the gas premix, it can be considered—as a first estimate and other parameters being considered equal—as being constant from minimum to full load of the burner. It has been noticed that when the ratio of the exit velocity (m/s) of the premix gas through the burner deck to the burning velocity (also in m/s) of the combustible gas is becoming low, the risk of flame flash back becomes high.

Figure 1A:
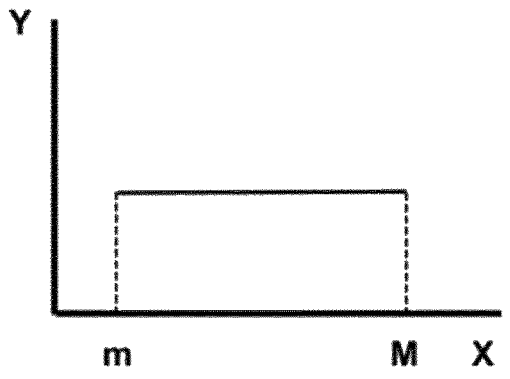
Figure 1B:
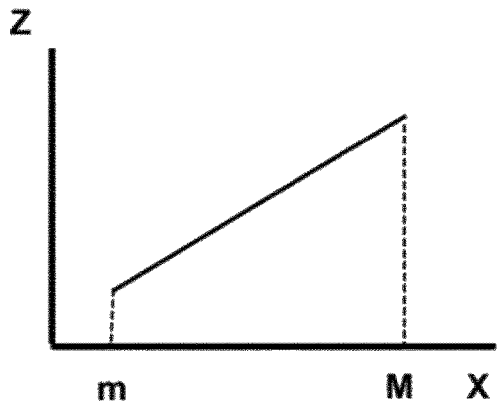

FIG. 1 schematically explains a method of controlling a surface stabilized fully premixed gas premix burner using a constant air to combustible gas ratio over the full range of burner operation from minimum to full burner load. FIG. 1(*a*) shows the air to combustible gas ratio (Y) as a function of the burner load (X, in kW) from minimum burner load (m) to full burner load (M). In the method of FIG. 1, the air to combustible gas ratio is kept constant. FIG. 1(*b*) shows—for the method of control as shown in FIG. 1(*a*)—in vertical axis the ratio (Z) of the exit velocity (m/s) of the premix gas through the burner deck to the burning velocity (also in m/s) of the combustible gas; as a function of burner load (X). This ratio is a straight line, having its minimum—and thus highest risk for flame flash back—at minimum burner load.

Figure 2A:
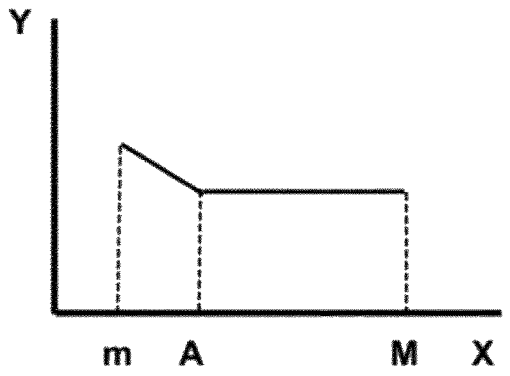
Figure 2B:
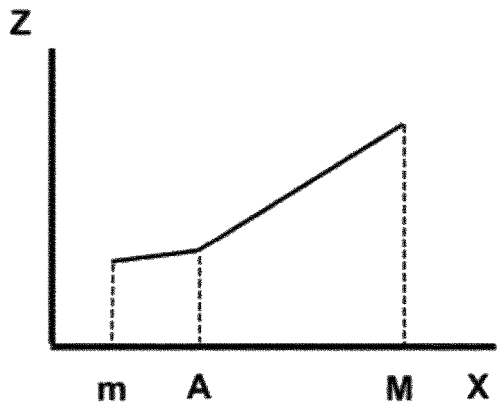

FIG. 2 schematically explains a method for controlling a surface stabilized fully premixed gas premix burner according to the invention. FIG. 2(*a*) shows the air to combustible gas ratio (Y) used as a function of the burner load (X, in kW), from minimum load (m) to full burner load (M). From full burner load down to burner load A a first value for the air to combustion gas ratio is used; for burner loads below A, a higher value (increasing with decreasing burner load) for the air to combustion gas ratio is set; which is at minimum burner load relatively at least 20% higher than the first valued. The consequence can be noticed in FIG. 2(*b*) showing the corresponding ratio (Z) of the exit speed over the burning speed for this method of controlling the burner. At burner load level A, the curve changes, wherein the minimum value the ratio (Z) of the exit velocity (m/s) of the premix gas through the burner deck to the burning velocity (also in m/s) of the combustible gas is increased considerably compared to the situation in FIG. 1(*a*). Therefore, the risk of flame flashback is drastically reduced. Furthermore, the higher amount of premix gas (because more air is supplied) will create an intensified cooling of the burner deck; further reducing the risk of flame flashback. The higher amount of premix reduces the flame speed of the mixture, further reducing the risk of flame flashback.

Figure 3A:
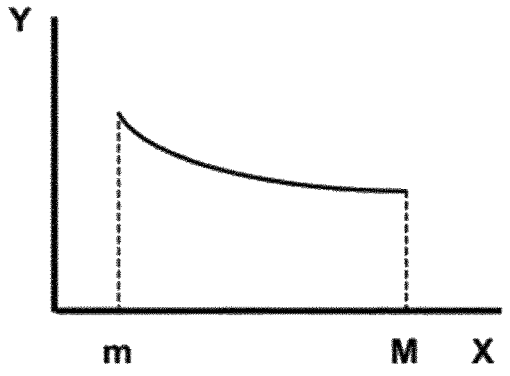
Figure 3B:
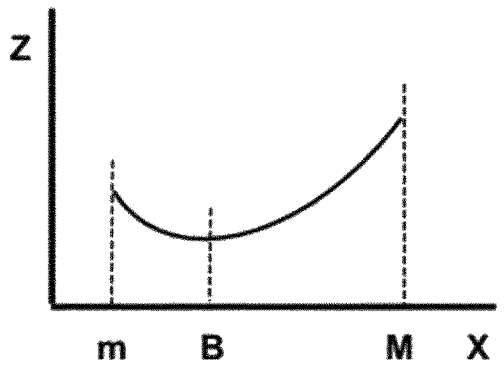

FIG. 3 schematically explains a method for controlling a surface stabilized fully premixed gas premix burner according to the invention. FIG. 3(*a*) shows the air to combustible gas ratio (Y) used as a function of the burner load (X, in kW), from minimum load (m) to full burner load (M). At minimum load, the air to combustible gas ratio is in relative terms at least 20% higher than at full burner load. The consequence of the air to combustible gas ratio over the burner load can be noticed in FIG. 3(*b*) showing the corresponding ratio (Z) of the exit speed over the burning speed for this method of controlling the burner. At burner load level B, the curve reaches a minimum. The minimum value of the exit speed over the burner speed is increased considerably compared to the situation in FIG. 1(*a*). Therefore, the risk of flame flashback is drastically reduced. Furthermore, the higher amount of premix gas (because more air is supplied) will create an intensified cooling of the burner deck; further reducing the risk of flame flashback. The higher amount of premix reduces the flame speed of the mixture, further reducing the risk of flame flashback.

In the embodiments of FIGS. 1, 2 and 3, normal operating conditions are applied.

Figure 4:
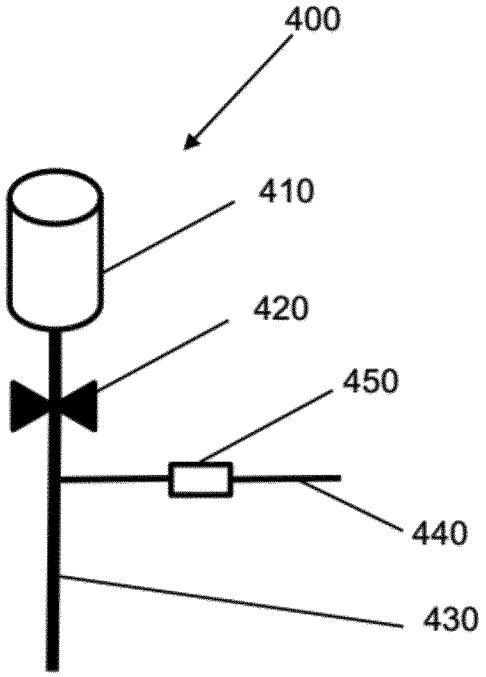
FIG. 4 shows an example of implementation of a method according to the invention.

FIG. 4 shows an example of implementation of a method according to the invention. FIG. 4 shows a surface stabilized fully premixed gas premix burner 400. The burner has a cylindrical perforated plate 410 as burner deck. A premix of air and combustible gas is supplied inside the cylindrical perforated plate. The combustible gas supplied to the burner comprises at least 20% by volume of hydrogen. The premix flows through the through holes in the cylindrical perforated plate. The gas is combusted at the outside of the cylindrical perforated plate. The combustion is stabilized at the outside of the cylindrical perforated plate. A fan 420 is provided to supply the premix into the cylindrical perforated plan. The fan aspires air (aspired via supply line 430) and combustible gas (via supply line 440) is fed into the air flow. A pneumatic gas valve 450 is used, the operational characteristics of which are predefined such that the air to combustible gas ratio as a function of the burner load is obtained, e.g. as shown in FIGS. 2(*a*), 3(*a*) or FIG. 5.

Figure 5:
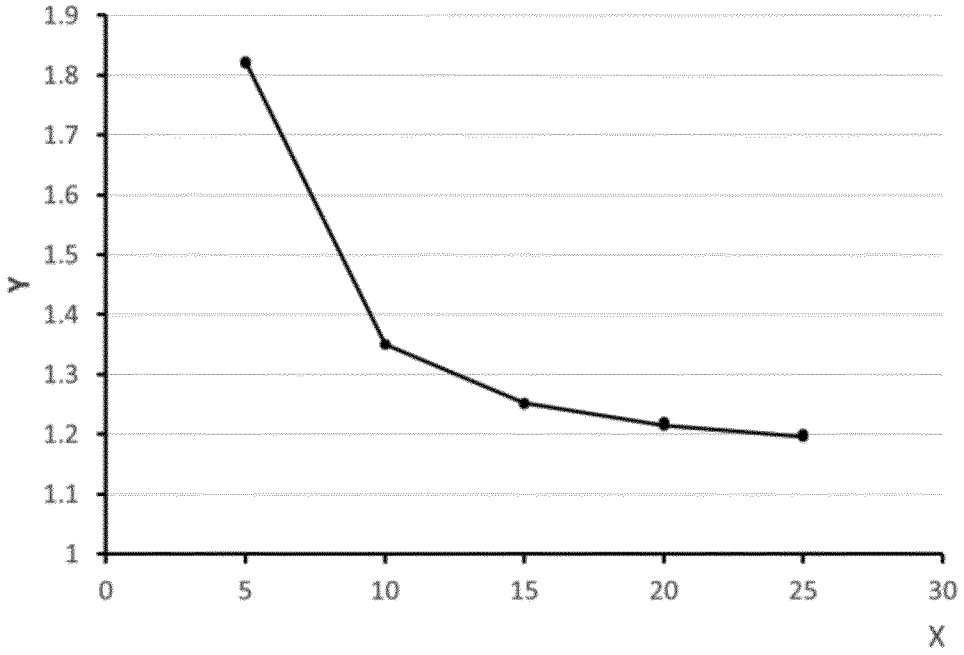
FIG. 5 shows an example of a predefined function for setting the air to combustible gas ratio of the premix gas supplied to the burner.

Alternatively, the amount of gas can be set as a function of the speed of the fan (which is known via the burner control, or which is measured) via a controlled valve, using a predefined function, thereby implementing the predefined function for setting the air to combustible gas ratio of the premix gas supplied to the burner; e.g. the function as shown in FIGS. 2(*a*), 3(*a*) or FIG. 5.

FIG. 5 shows a practical example of a predefined function for setting the air to combustible gas ratio of the premix gas supplied to the burner. A cylindrical perforated plate burner was operated between minimum load 5 kW and full load 25 kW. The surface stabilized fully premixed cylindrical burner had 63 mm diameter and 158.4 mm length. The cylindrical burner had along its length an unperforated section with length 32 mm at the flange for premix supply; and at the end plate an unperforated length of 14.6 mm. The perforations were circular having 0.8 mm diameter and were uniformly distributed over a length of 111.8 mm of the burner. The porosity of the burner deck was 1.5%. The burner was operated with 100% hydrogen as combustible gas; and using the function as shown in FIG. 5 for the ratio of air to combustible gas (Y-axis) as a function of the burner load (axis X, in kW). The experiments showed total absence of flame flash back.

FIG. 6 schematically shows an embodiment of a burner system 500 according to the invention.

The burner system 500 comprises a burner 501 comprising a burner deck 502. The burner deck 502 comprises a plurality of holes 503. In the burner 501 of the burner system 500, the combined surface area of the holes 503 up to 5% of the surface area of the burner deck 502. This allows the burner system to use combustible gas which contains at least 20% by volume of hydrogen. The blind zones 504 do not have holes 503 in them, and therefore are not part of the burner deck 502.

In the embodiment of FIG. 6, the burner deck 502 is formed by a cylindrical perforated metal plate. The premix of air and combustible gas flows from the inside of the cylindrical perforated metal plate through the perforations (i.e. the holes 503) of the cylindrical perforated metal plate to its outside where it is combusted. Optionally, the cylindrical perforated metal plate is closed at one end by a metal end cap.

Optionally, the burner 501 comprises a gas distributor which is adapted to distribute the gas over the burner deck in a predetermined way.

The burner system 500 further comprises an air inlet 510, a combustible gas inlet 520 and a mixer 530 which is in communication with the air inlet 510 and the combustible gas inlet 520. The mixer 530 is adapted to mix air and combustible gas to a premix of combustible gas and air at an air to combustible gas ratio. Optionally, the mixer 530 is or comprises a venturi.

The combustible gas inlet 520 is suitable for receiving a combustible gas which contains at least 20% by volume of hydrogen. This is for example achieved by that the combustible gas inlet 520 meets any regulatory requirements for retaining such a combustible gas, that the combustible gas inlet is made of a suitable material and/or that the combustible gas inlet is connectable, either directly or indirectly, to a source of combustible gas which contains at least 20% by volume of hydrogen.

The burner system 500 further comprises a burner inlet 540 which is adapted to receive the premix of combustible gas and air from the mixer 530 and supply it to the burner 501. The burner inlet 540 is arranged upstream of the mixer 530 and downstream of the burner 501, as seen in the direction of the flow of combustible gas and air through the burner system.

The burner system 500 further comprises a burner load controller 561, which is adapted to vary the load of the burner between a minimum load and a full load. The ratio of the full load over the minimum load is at least 4, optionally more than 4, therewith allowing the burner to modulate between the minimum load and the full load. The burner load controller controls the load of the burner e.g. by a valve or fan 563.

In the embodiment of FIG. 6, the burner load controller forms part of an overall burner control system 560.

The burner 501 is adapted to modulate between a minimum load and a full load. The ratio of the full load over the minimum load is at least 4, optionally more than 4; and preferably more than 5, more preferably more than 7, even more preferably more than 10.

The burner system 500 further comprises a mechanism 570 which is adapted to set the air to combustible gas ratio of the premix of combustible gas and air which is created by the mixer 530. The setting of the air to combustible gas ratio of the premix of combustible gas and air is at least partially dependent from the load of the burner 501. The air to combustible gas ratio of the premix which is supplied to the burner 501 when the burner 501 is operated at minimum load is set by the mechanism 570 to be in relative terms at least 20% higher than the air to combustible gas ratio of the premix which is supplied to the burner 501 when the burner 501 is operated at full load.

The mechanism 570 for example comprises a pneumatic gas valve, which is adapted to set the rate of supply of combustible gas to the burner, in order to set the air to combustible gas ratio of the premix supplied to the burner as a predefined function of the burner load. The pneumatic gas valve for example comprises a spring, and wherein properties of the spring determine at least in part the predefined function.

In the burner system 500 of FIG. 6 further comprises a controller 562. The controller 562 is programmed to control the mechanism 570 such that the air to combustible gas ratio of the premix which is supplied to the burner 501 when the burner is operated at minimum load is set by the mechanism 570 to be in relative terms at least 20% higher than the air to combustible gas ratio of the premix which is supplied to the burner 501 when the burner 501 is operated at full load.

In the embodiment of FIG. 6, the controller 562 forms part of the overall burner control system 560.

In the embodiment of FIG. 6, the fan 563 of the burner load controller 561 is arranged to supply the premix of combustible air and gas to the burner 501.

FIG. 7 schematically shows a variant of the embodiment of FIG. 6.

In the embodiment of FIG. 7, the burner system 500 further comprises a sensor 590. The sensor 590 is adapted to measure the amount of air supplied to the burner 501. The sensor 590 is in this embodiment arranged in the burner inlet 540, but alternatively it can be arranged for example in the air inlet 510.

In the embodiment of FIG. 7, the burner system 500 further comprises a combustible gas supply controller 591 which is adapted to control the amount of combustible gas supplied to the mixer 530, and therewith, also the amount of combustible gas supplied to the burner 501.

The combustible gas supply controller 591 is adapted to set the amount of combustible gas supplied to the burner 501 according to a predefined relation to the amount of air supplied to the burner 501 as measured by the sensor 590.

The combustible gas supply controller 591 optionally comprises a fan. This fan optionally forms part of a burner load controller and/or is controlled by a burner load controller or elements thereof. In case such a fan is used in the combustible gas supply controller 591, the fan 563 of the embodiment of FIG. 6 may be dispensed with.

FIG. 8 schematically shows a variant of the embodiment of FIG. 6.

In the embodiment of FIG. 8, the burner system 500 further comprises a sensor 592. The sensor 592 is adapted to measure the amount of combustible gas supplied to the burner 501. The sensor 592 is in this embodiment arranged in the burner inlet 540, but alternatively it can be arranged for example in the combustible gas inlet 520.

In the embodiment of FIG. 8, the burner system 500 further comprises an air supply controller 593 which is adapted to control the amount of air supplied to the mixer and therewith, also the amount of air supplied to the burner 501. The air supply controller 593 is adapted to set the amount of air supplied to the burner 501 according to a predefined relation to the amount of combustible gas supplied to the burner 501 as measured by the sensor 592.

The air supply controller 593 optionally comprises a fan. This fan optionally forms part of a burner load controller and/or is controlled by a burner load controller or elements thereof. In case such a fan is used in the air supply controller 593, the fan 563 of the embodiment of FIG. 6 may be dispensed with.

The invention claimed is:

1. A method for operating a surface stabilized fully premixed gas premix burner, wherein the burner is adapted to modulate between a minimum load and a full load, and wherein the ratio of the full load over the minimum load is at least 4, wherein the method comprises the step of supplying a premix of combustible gas and air to the burner at an air to combustible gas ratio, wherein the combustible gas supplied to the burner comprises at least 20% by volume of hydrogen, and wherein the air to combustible gas ratio of the premix which is supplied to the burner when the burner is operated at minimum load is set by a mechanism at least 20% higher than the air to combustible gas ratio of the premix which is supplied to the burner when the burner is operated at full load.

2. The method according to claim 1, wherein the air to combustible gas ratio at average load is less than 10% higher than the air to combustible gas ratio at full load, and wherein the average load is defined as the average between minimum load and full load.

3. The method according to claim 1, wherein the air to combustible gas ratio of the premix gas supplied to the burner at full load is less than 1.3.

4. The method according to claim 1, wherein the air to combustible gas ratio of the premix gas which is supplied to the burner is set by the mechanism as a predefined function of the burner load.

5. The method according to claim 4, wherein a pneumatic gas valve is used by the mechanism to set the rate of supply of combustible gas to the burner, in order to set the air to combustible gas ratio of the premix supplied to the burner as a predefined function of the burner load.

6. The method according to claim 5, wherein a pneumatic gas valve is used which comprises a spring, and wherein properties of the spring determine at least in part the predefined function.

7. The method according to claim 1, wherein air or the premix of combustible air and gas is supplied to the burner by a fan, and wherein the amount of air supplied to the burner is measured by a sensor or wherein the fan speed is used as an indication for the amount of air supplied to the burner, and wherein the amount of combustible gas supplied to the burner is set according to a predefined relation to the amount of air supplied to the burner.

8. The method according to claim 1, wherein air or the premix of combustible air and gas is supplied to the burner by a fan, and wherein the amount of combustible gas supplied to the burner is measured by a sensor, and wherein the amount of air supplied to the burner is set according to a predefined relation to the amount of combustible gas supplied to the burner.

9. The method according to claim 1, wherein air or the premix of combustible air and gas is supplied to the burner by a fan, wherein a value providing information of the combustion, of the flue gas and/or of the air to gas mixture supplied to the burner is measured by at least one sensor, and wherein this value is used in combination with a value indicative of the burner load, of the fan speed and/or of the flow rate of air supplied to the burner to set the air to combustible gas ratio.

10. The method according to claim 9, wherein the at least one sensor is or comprises a temperature sensor, and wherein the value providing information of the combustion is representative for the flue gas temperature or for the flame temperature of the burner.

11. The method according to claim 9, wherein the burner comprises a burner deck onto which combustion is stabilized when the burner is in operation, and wherein the at least one sensor is or comprises a temperature sensor and the value providing information of the combustion is representative for the temperature of the burner deck of the burner.

12. The method according to claim 9, wherein the at least one sensor is provided to measure a value representative for the oxygen content of the flue gas generated by the burner or representative for the oxygen content of the premix of air and combustible gas supplied to the premix burner.

13. The method according to claim 1, wherein the burner which is used comprises a perforated metal plate onto which the flames are stabilized.

14. A surface stabilized fully premixed gas premix burner system, wherein burner system comprises:

a burner comprising a burner deck, which burner deck comprises a plurality of holes, wherein optionally the combined surface area of the holes is up to 5% of the surface area of the burner deck, an air inlet, a combustible gas inlet and a mixer which is in communication with the air inlet and the combustible gas inlet, which mixer is adapted to mix air and combustible gas to a premix of combustible gas and air at an air to combustible gas ratio, wherein the combustible gas inlet is suitable for receiving a combustible gas which contains at least 20% by volume of hydrogen, a burner inlet which is adapted to receive the premix of combustible gas and air and supply it to the burner, a burner load controller, which is adapted to vary the load of the burner between a minimum load and a full load, and wherein the ratio of the full load over the minimum load is at least 4, therewith allowing the burner to modulate between the minimum load and the full load, and a mechanism which is adapted to set the air to combustible gas ratio of the premix of combustible gas and air which is created by the mixer, which setting of the air to combustible gas ratio of the premix of combustible gas and air is at least partially dependent from the load of the burner, and wherein the air to combustible gas ratio of the premix which is supplied to the burner when the burner is operated at minimum load is set by the mechanism to be at least 20% higher than the air to combustible gas ratio of the premix which is supplied to the burner when the burner is operated at full load.

15. The burner system according to claim 14, wherein the burner system further comprises a controller, which controller is programmed to control the mechanism such that the air to combustible gas ratio of the premix which is supplied to the burner when the burner is operated at minimum load is set by the mechanism to be at least 20% higher than the air to combustible gas ratio of the premix which is supplied to the burner when the burner is operated at full load.

16. The burner system according to claim 15, wherein the burner system further comprises:

a fan, which fan is arranged to supply air to the mixer or to supply the premix of combustible air and gas to the burner, a sensor, which sensor is adapted to measure a value providing information of the combustion, of the flue gas and/or of the air to gas mixture supplied to the burner, therewith generating measurement data pertaining to said value, wherein the controller is adapted to receive the measurement data pertaining to said value from the sensor and to use said measurement data in combination with a value indicative of the burner load, of the fan speed and/or of the flow rate of air supplied to the burner to control the mechanism to set the air to combustible gas ratio of the premix.

17. The burner system according to claim 16, wherein the at least one sensor is or comprises a temperature sensor and wherein the value providing information of the combustion is representative for the flue gas temperature and/or for the flame temperature of the burner.

18. The burner system according to claim 16, wherein the at least one sensor is or comprises a temperature sensor and the value providing information of the combustion is representative for the temperature of the burner deck of the burner.

19. The burner system according to claim 16, wherein the at least one sensor is adapted to measure a value representative for the oxygen content of the flue gas generated by the burner or representative for the oxygen content of the premix of air and combustible gas supplied to the burner.

20. The burner system according to claim 14, wherein the mechanism is adapted to set the air to combustible gas ratio of the premix gas which is supplied to the burner as a predefined function of the burner load.

21. The burner system according to claim 14, wherein the mechanism comprises a pneumatic gas valve, which pneumatic gas valve is adapted to set the rate of supply of combustible gas to the burner, in order to set the air to combustible gas ratio of the premix supplied to the burner as a predefined function of the burner load.

22. The burner system according to claim 21, wherein the pneumatic gas valve comprises a spring, and wherein properties of the spring determine at least in part the predefined function.

23. The burner system according to claim 14, wherein the burner system further comprises a fan, which fan is arranged to supply air to the mixer or to supply the premix of combustible air and gas to the burner.

24. The burner system according to claim 23, wherein the burner system further comprises:

a sensor, which sensor is adapted to measure the amount of air supplied to the burner, a combustible gas supply controller which is adapted to control the amount of combustible gas supplied to the mixer and/or to the burner, which combustible gas supply controller is adapted to set the amount of combustible gas supplied to the burner according to a predefined relation to the amount of air supplied to the burner as measured by the sensor.

25. The burner system according to claim 23, wherein the fan has a variable fan speed, and wherein the burner system further comprises:

a combustible gas supply controller which is adapted to control the amount of combustible gas supplied to the mixer and/or to the burner, which combustible gas supply controller is adapted to set the amount of combustible gas supplied to the burner according to a predefined relation to the amount of air supplied to the burner, for which amount of air the fan speed of the fan is a measure.

26. The burner system according to claim 23, wherein the burner system further comprises:

a sensor, which sensor is adapted to measure the amount of combustible gas supplied to the burner, an air supply controller which is adapted to control the amount of air supplied to the mixer and/or to the burner, which air supply controller is adapted to set the amount of air supplied to the burner according to a predefined relation to the amount of combustible gas supplied to the burner as measured by the sensor.

* * * * *